United States Patent [19]

Simmons

[11] 4,269,161

[45] May 26, 1981

[54] VARIABLE FUEL EXPLOSION CHAMBER ENGINE

[76] Inventor: William F. Simmons, 541 March St., Shillington, Pa. 19607

[21] Appl. No.: 58,680

[22] Filed: Jul. 18, 1979

[51] Int. Cl.[3] ..... F02P 1/00

[52] U.S. Cl. ..... 123/620; 123/594; 123/605; 315/241 R

[58] Field of Search ..... 123/148 DC, 148 CB, 123/148 E, 148 R, 148 AC, 143 B, 594, 596, 605, 620; 315/241 R, 209 CD; 313/128, 138

[56] References Cited

U.S. PATENT DOCUMENTS

| | | | |
|---|---|---|---|
| 2,894,161 | 7/1959 | Sheheen | 315/241 R |
| 2,923,858 | 2/1960 | Trautner | 315/241 R |
| 2,977,509 | 3/1961 | Barstow et al. | 315/241 R |
| 3,032,683 | 5/1962 | Ruckelshaus | 315/241 R |
| 3,274,440 | 9/1966 | Stimler | 315/241 R |
| 3,749,975 | 7/1973 | Walters | 315/241 R |
| 4,122,816 | 10/1978 | Fitzgerald et al. | 123/148 DC |

*Primary Examiner*—P. S. Lall

*Attorney, Agent, or Firm*—William J. Ruano

[57] ABSTRACT

An expolsion chamber including a principle which allows a method of exploding various fuel vapors other than gasoline. High electrical energy input to the system is maximized as less combustible vapors are exploded.

The two unique features of the system are: 1. The timing is automatically set by standard ignition control which triggers the high energy exploding sequence. 2. Both the ignition injection and the high energy discharge are fed into the exploding chamber with the same electrode. This is possible through the utilization of a high voltage, high current diode stack. The stack is constructed, for example, of 288 diodes. The total peak inverse voltage (PIV) is about 24 kilovolts for ignition preservation and the current discharge surge is about 600 amperes. In the multiple chamber engine, one diode stack is required for each chamber. In the four chamber engine about 1,152 diodes are utilized. High power rheostats are placed in series with the stacks to control the dwell time of the electrical discharge.

10 Claims, 5 Drawing Figures

VARIABLE FUEL EXPLOSION CHAMBER ENGINE

This invention relates to a variable fuel explosion chamber engine.

Present gasoline explosion chamber engines are not suited for exploding fuel vapors other than gasoline. One of the reasons is that insufficiently high electrical energy is provided which is incapable of exploding less combustible vapors.

Also the timing is not automatically set by standard ignition control for triggering high energy exploding sequence. Moreover, different electrodes are required for ignition injection and high energy charge feed into the exploding chamber.

An object of the present invention is to overcome the above-named disadvantages of the presently used explosion chamber engine.

A more specific object of the invention is to provide a novel explosion chamber engine capable of exploding various fuels of less combustible vapor than gasoline.

Another object of the invention is to provide automatically set timing for triggering a high energy exploding sequence.

Still another object of the invention is to provide a system wherein both the ignition injection and the high energy discharge are fed into the exploding chamber with the same electrode, which is made possible by utilizing a high voltage, high current diode stack.

Other objects and advantages of the invention will become more apparent from a study of the following description, taken with the accompanying drawing wherein.

Figure 1:
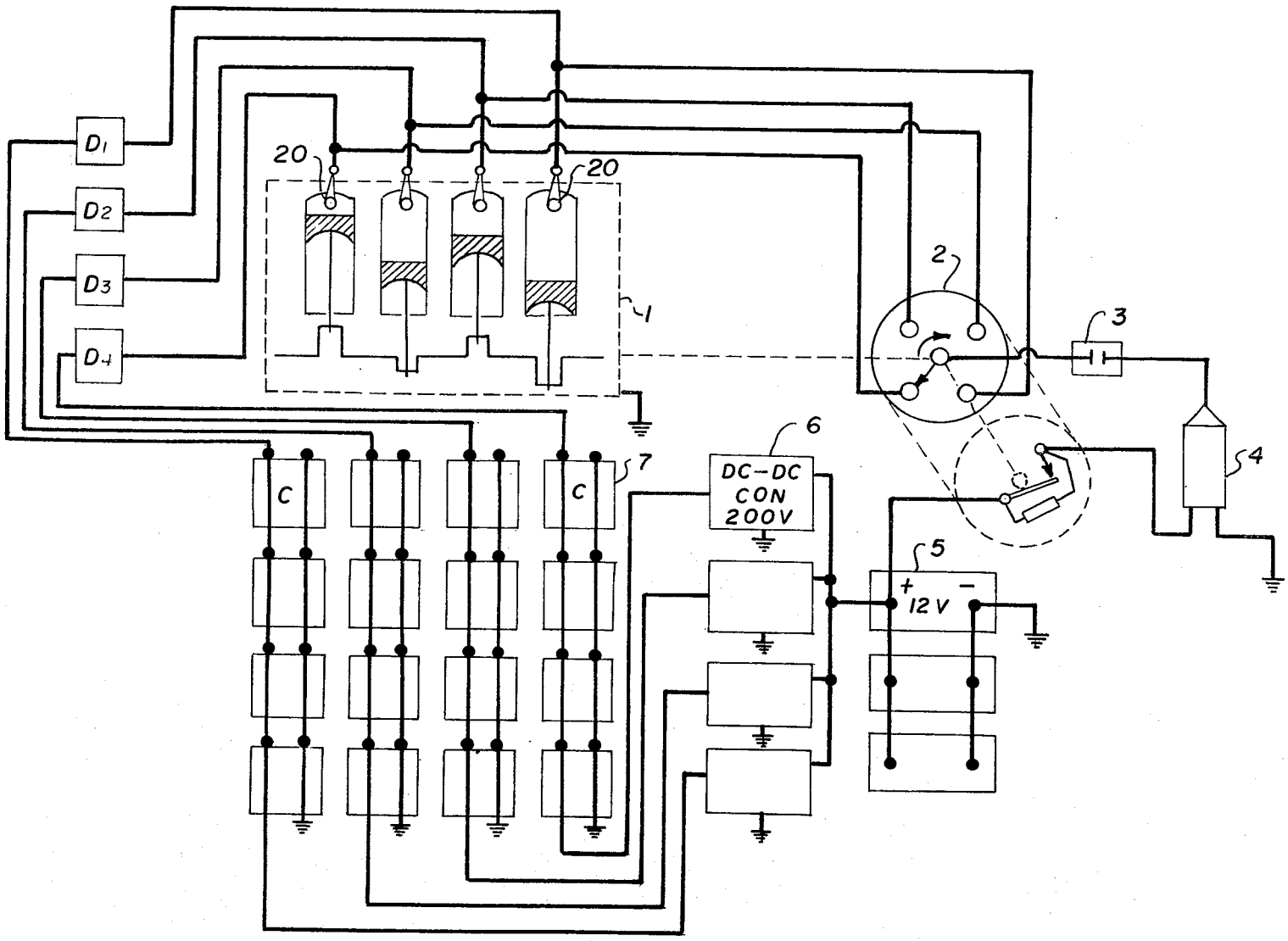
FIG. 1 is a circuit diagram of a four cylinder, variable fuel explosion chamber engine embodying the present invention.

Referring more particularly to FIG. 1 of the drawing, numeral 1 denotes a four cylinder engine whose ignition is controlled by a distributor 2, D C blocking capacitor 3 and a coil 4 which is grounded. The power supply is by three 12 volt batteries 5 connected to four D C to DC 200 volt converters 6 which, in turn, are connected to four banks of four 50 μfd 200 volt capacitors 7 which are connected through diodes D1, D2, D3 and D4 to the discharge spheres 20 of engine 1.

Figure 2:
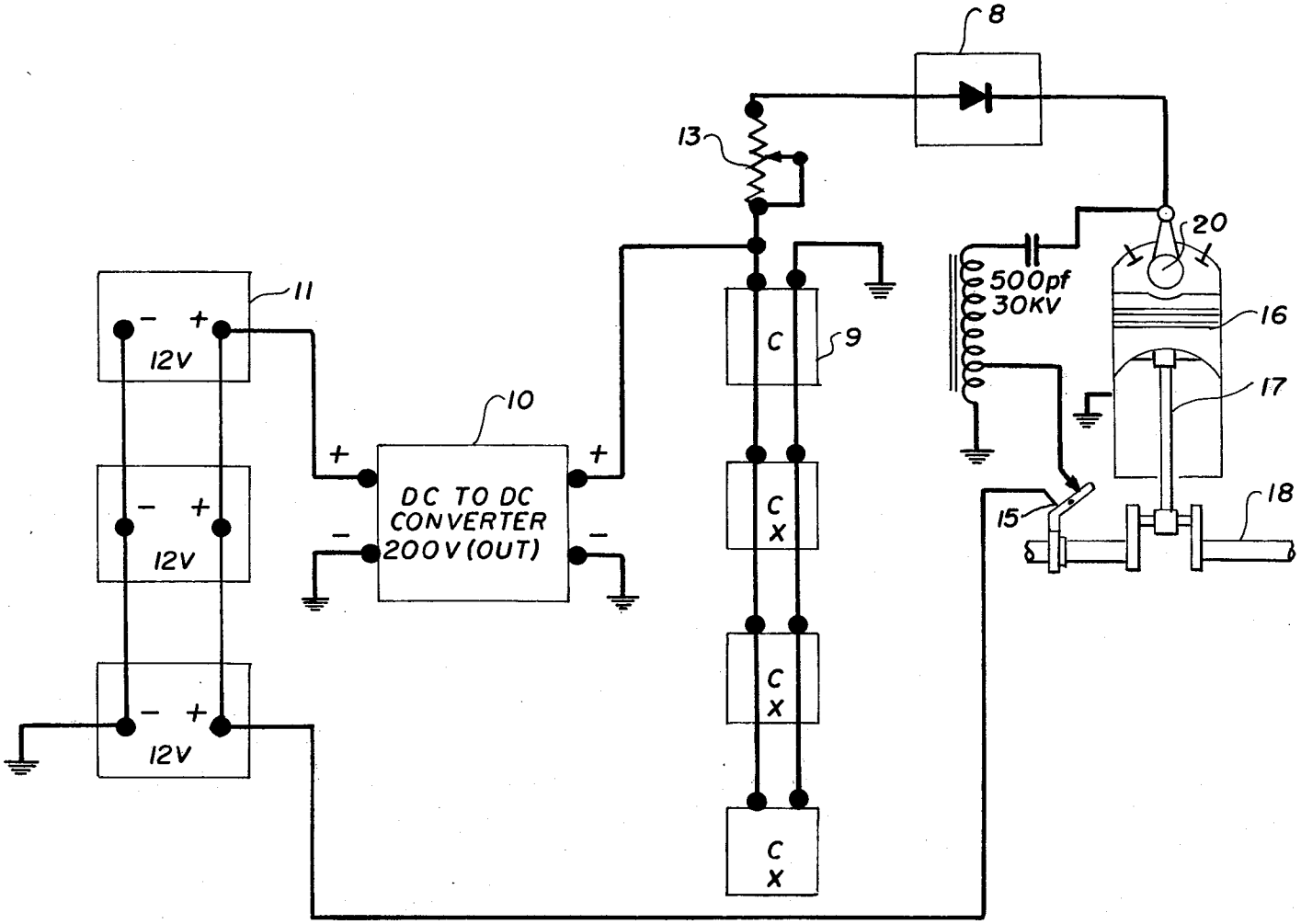
FIG. 2 is a circuit diagram of a single chamber system.

FIG. 2 shows a single chamber system. The four capacitors 9 are 50 microfarad 200 volt oil-filled low resistance capacitors. The number of capacitors may be increased as greater energies are desired. The capacitors are charged by D C to D C converters 10 powered by three storage batteries 11. The converter is a 12 volt to 200 volt power supply. The current rating is a function of recovery charge time desired, which increases with chamber firing and engine speed. A reservoir capacitor bank ring switching system provides extremely high engine speed, without laboring any one single power supply between discharges. The bank contains a number of separate power supplies and capacitors for each chamber.

The capacitor bank 9 and its power supplies (batteries 11 and D C to D C converters 10) are completely separate from the ignition system of the engine. This allows a more versatile adjustment system for various fuels. There are no common transformer windings. The diode stack 8 is unique. About 288 diodes in one stack eliminates the need for isolation inductances which limit energy discharge levels. The stack 8 allows both ignition pulse and high energy to be fed into the system with the same electrode 20 (hot ignition and discharge sphere). Capacitor bank 9 and D C to D C converters 10 may be added to any conventional type coil-distributor system without any changes in the original system, except a 500 pf 30 kv capacitor should be installed between the center of the distributor and the high voltage terminal of the coil. If less combustible fuels are to be exploded, the conventional cylinders must be altered to the explosion chamber type and modifications in the fuel injection system are necessary. Here, also, exhaust ignition may be eliminated. The use of a reservoir capacitor bank ring switching system increases charge time, allows the use of higher capacities at lower voltages, and renders the energy injection almost limitless. With very high levels of injected electrical energy possible, solid fuel vapors are a distinct possibility. Capacitor energy build-up need not take place during the same-cycle of ignition. A same-cycle system as used in the prior art, limits energy build-up, and exploding less combustible fuels is impossible. The variable fuel explosion chamber engine does not need a high current distribution system, unless high speed is desired and the reservoir capacitor bank ring switching must be used. The present invention uses only one ignition coil, not one coil for each cylinder or chamber. Since the energy stored is proportional to the square of the voltage on the capacitor, high voltage capacitors should be used to obtain high energies. However, high voltage capacitors and transformers are physically large and undesirable. Most high voltage transformers have high internal resistances (loss of energy). The present system allows the use of higher capacities at lower voltages. The capacitor bank charging resistance should be limited to transformer winding and rectifying diode resistance. No pulsed transistors should be used. The present system does not use transistors or SCRs.

Figure 3:
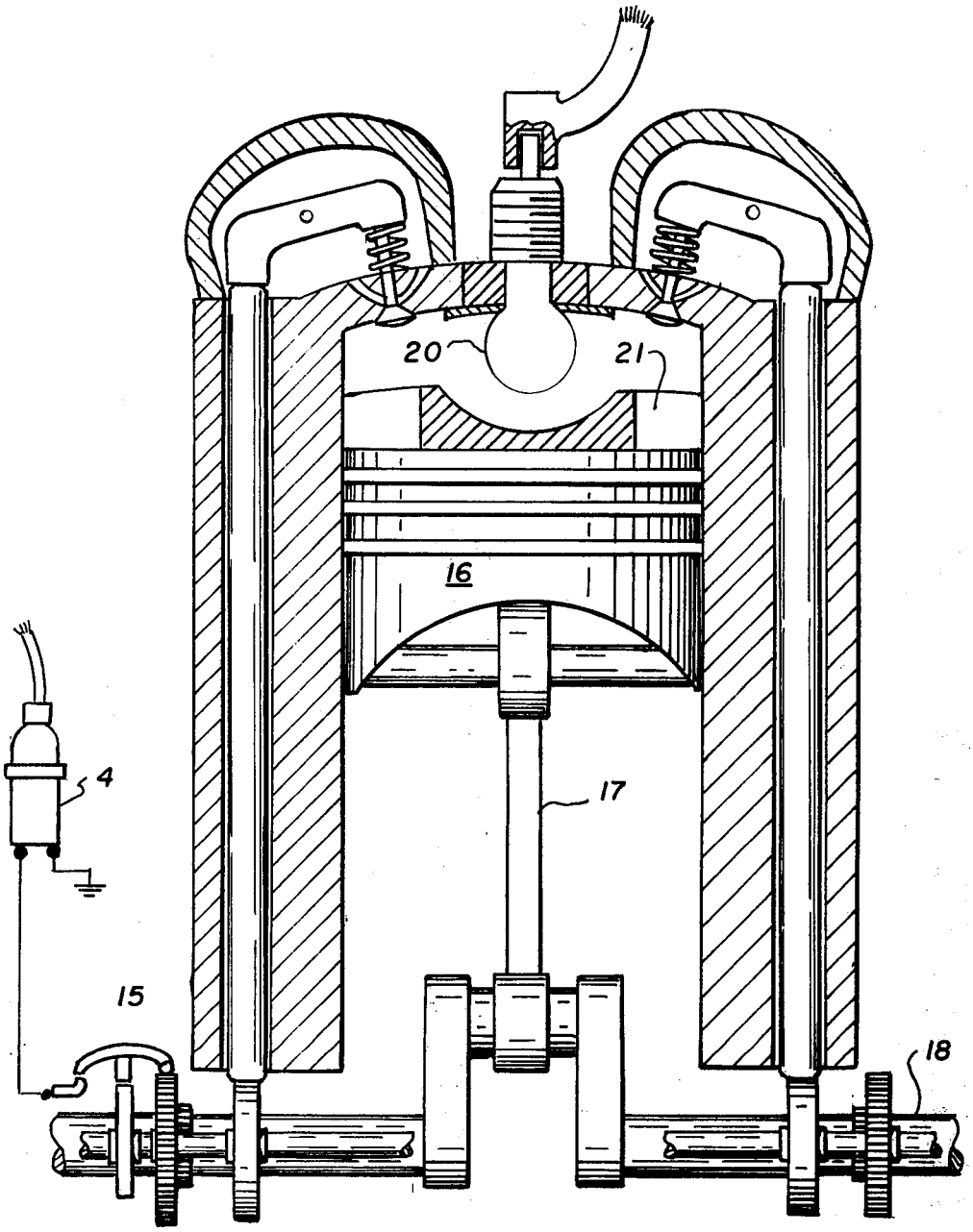
FIG. 3 is an enlarged, vertical cross-sectional view of the chamber structure shown in FIG. 2.

As shown in FIG. 2, the dwell rheostat 13 is preferably placed to the left of diode stack 8 so as to reduce the high voltage requirement of the control. FIG. 3 shows the chamber structure of FIG. 1. The fuel intake is conventional. Venturi tube fuel-air mixture control is utilized. Using various fuels requires wide ranges of adjustment and alternate attachments to the fuel intake system. The drive and escapement mechanisms are also standard. This includes the piston 16, connecting rod 17 and crankshaft 18. The hot ignition sphere 20 is located in the top center of the chamber. This sphere provides symmetrical ignition triggering and discharge to the ground discharge ring 21 below. Adequate electrical and mechanical seal is required for the sphere. 24 kilovolt insulation is required and the chamber pressure must be contained.

The sequence of operation, of the system shown in FIG. 2, starts with the charging of the four oil capacitors 9. The fuel air mixture enters the chamber as the crankshaft is cranked on the down stroke of the piston. The upward stroke compresses the mixture. At the peak of compression, the ignition breaker points 15 open. The steady primary coil current (steady magnetic field) is interrupted, producing the 20 kilovolt ignition pulse. The positive ignition pulse is not grounded by the oil capacitors 9 because the diode stack 8 is reversed biased. Previous to ignition, the oil capacitors 9 do not discharge because the chamber sphere 20 and ground ring circuit have only fuel vapor between them, without ignition. This essentially produces an open circuit. Once the ignition pulse has ionized the gap, the explosion avalanche occurs, discharging the oil capacitors 9 through the diode stack 8 and the dwell rheostat 13. For continuous rotary motion, the oil capacitors 9 must recharge from the D C to D C power supply before the next ignition pulse occurs. This timing is controlled by the crankshaft rotation. Since the electrical energy level can be raised to indefinite maximums (recovery time, refer to earlier paragraph) almost any vapor can be exploded, providing the chamber materials can contain the explosion. Single and low repetitive rate explosions have proven quite successful using 5, 20 microfarad 20,000 volt oil-filled capacitors. This is 20,000 joules of energy.

Figure 4:
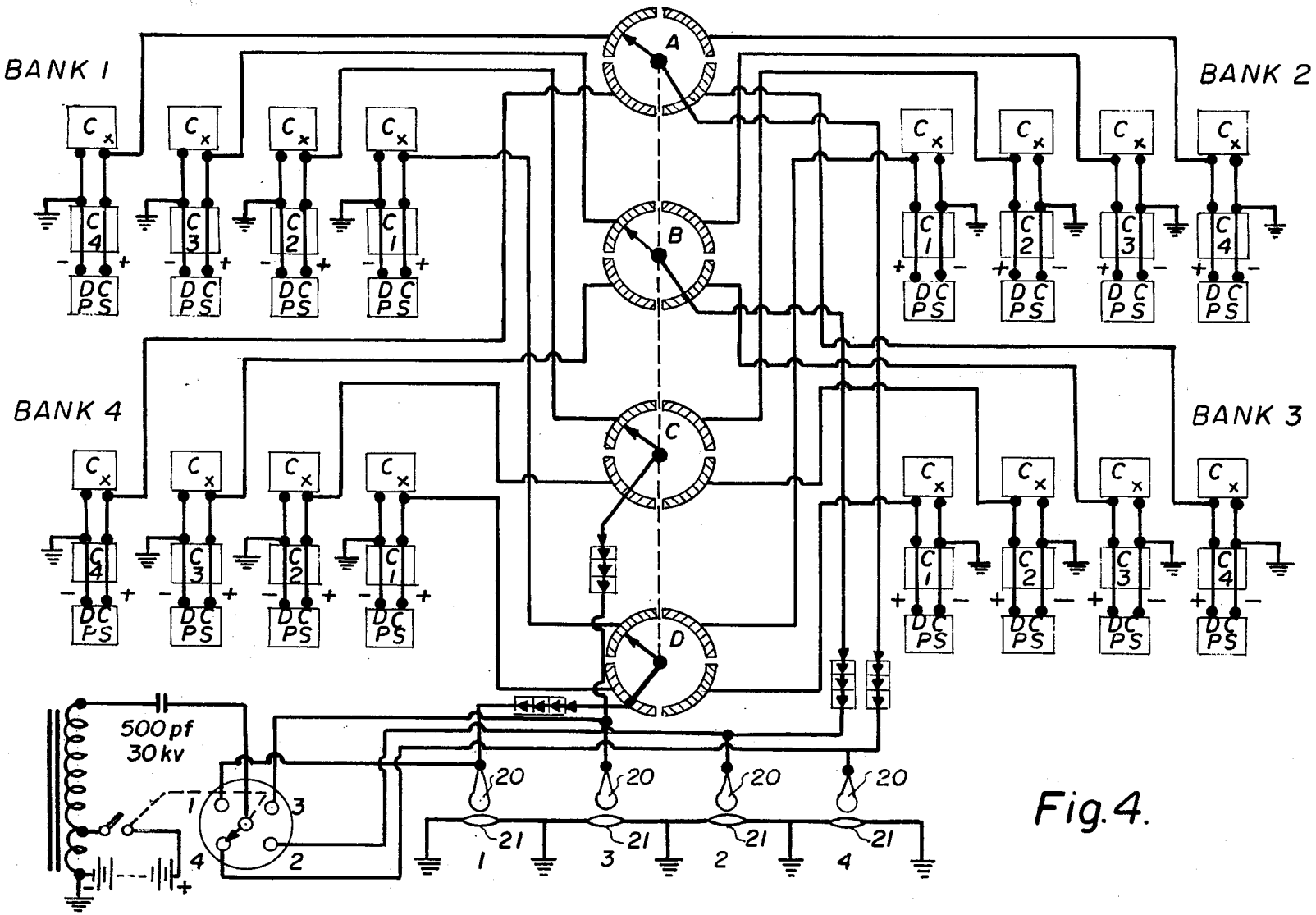
FIG. 4 is a circuit diagram of a four bank switching system.

FIG. 4 shows a four bank switching system. A single capacitor section has 15 firings to recover its charge. Ignition rotor speed is 4 times the high energy timing ring speed. FIG. 4 is a reservoir capacitor bank ring switching system. This system must be utilized when higher energies are desired at higher engine rpms. At higher rpms with less combustible fuel, more electrical energy is needed. Under these conditions, there is less time for recharging the high energy capacitors from their respective power supplies.

These capacitors banks, Nos. 1,2, 3 and 4, provide an alternate system for charge and discharge where three banks are charging while one bank is discharging. Power supply resistance and capacitor value form this lagging parameter.

The system contains high current distribution rings, A,B,C, and D. Each ring contains four sections and all operate off of the same rotor shaft, geared at ¼ the speed of the ignition distributor rotor. The 4 to 1 ratio is used because 4 capacitor banks are desired. The number of banks may be increased if longer restoration times are desired when higher value capacities and higher voltages are used. For instance, if four banks are used, 15 firings times would be allotted for a given capacitor to recharge. If five banks are used, 19 firings would take place before a given capacitor would be called on to discharge again. If six banks are used, 23 firings would occur, seven banks 27 firings, eight banks 31 firings, nine banks 35 firings, ten banks 39 firings, eleven banks 43 firings, twelve banks 47 firings etc. This timing system must be used to obtain full charge, high energy, high speed electrical discharge sequences. Allowable recovery time in single capacitor, single power supply systems is short. RC charging time constants are long at high energies, and recovery time short, therefore, full charge cannot be reached on the capacitor. Higher energies represent longer RCs. Longer RCs represent longer charging times. Using the reservoir principle, makes energy levels and high engine speeds limitless.

Figure 5:
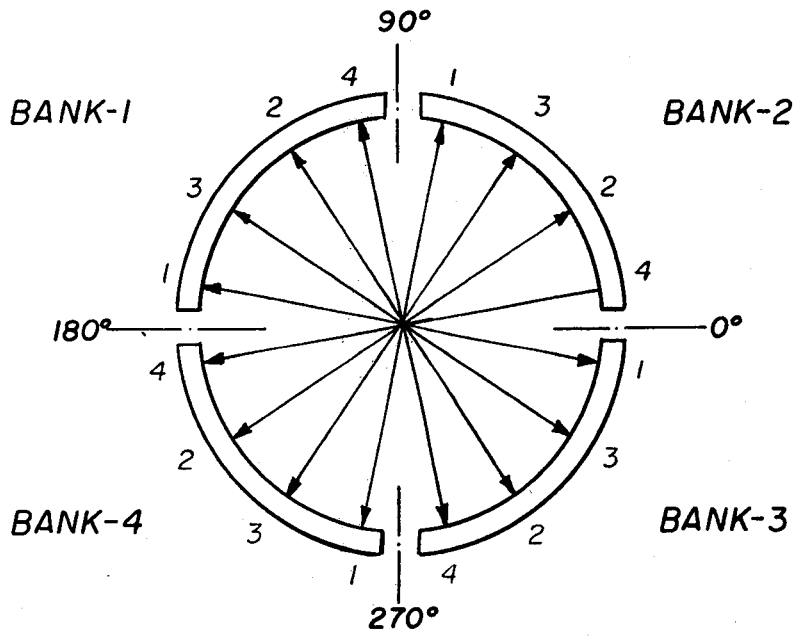
FIG. 5 is a plan view of a high energy distribution timing ring.

Referring to FIGS. 4 and 5, at 180 degrees all rotors are to the left. Rotation is clockwise from 180 degrees toward 90 degrees. Power is drawn from bank 1, through D rotor at position 1, at 180 degrees minus 11.25 degrees or 168.75 degrees. At 168.75 degrees minus 22.5 degrees or 146.25 degrees No. 3 chamber fires (2nd firing) drawing power from bank No. 1 through rotor C at position No. 3. The third firing (chamber No. 2) is at 146.25 degrees minus 22.5 degrees or 123.75 degrees, rotor B, position No. 2. The fourth firing (chamber No. 4) occurs at 123.75 degrees minus 22.5 degrees or 101.25 degrees. This is position No. 4, bank No. 1, rotor A. This is the last firing in the 2nd quadrant and last power drawn from bank No. 1. Passing the 90 degree slot, then the ignition rotor has completed 360 degrees rotation for a D C B A rotation of 90 degrees. The high energy rotor moves into the 1st quadrant and bank No. 2. At 101.25 degrees minus 22.5 degrees or 78.75 degrees, power is drawn from bank No. 2, through position No. 1, rotor D. This is the fifth firing in sequence and the second firing of chamber No. 1, however, the energy for the second firing of No. 1 chamber has come from bank No. 2. Bank No. 1 capacitors are now recharging. At 78.75 degrees minus 22.5 degrees or 56.25 degrees, the 6th firing occurs. This is the second firing of chamber No. 3. The power comes from bank No. 2, rotor C, position No. 3. At 33.75 degrees, the 7th firing occurs. This is bank No. 2, rotor B, position 2.

The following is a chart of the firing sequence:

| FIRING NUMBER | IGNITION ROTOR POSITION | CAPACITOR BANK NO. & CAP | | ROTOR | ROTOR POSITION | ANGLE DEGREES |
|---|---|---|---|---|---|---|
| 1 | 1 | 1 | (1) | D | 1 | 168.75 |
| 2 | 3 | 1 | (2) | C | 3 | 146.25 |
| 3 | 2 | 1 | (3) | B | 2 | 123.75 |
| 4 | 4 | 1 | (4) | A | 4 | 101.25 |
| 5 | 1 | 2 | (1) | D | 1 | 78.75 |
| 6 | 3 | 2 | (2) | C | 3 | 56.25 |
| 7 | 2 | 2 | (3) | B | 2 | 33.75 |
| 8 | 4 | 2 | (4) | A | 4 | 11.25 |
| 9 | 1 | 3 | (1) | D | 1 | 348.75 |
| 10 | 3 | 3 | (2) | C | 3 | 326.25 |
| 11 | 2 | 3 | (3) | B | 2 | 303.75 |
| 12 | 4 | 3 | (4) | A | 4 | 281.25 |
| 13 | 1 | 4 | (1) | D | 1 | 258.75 |
| 14 | 3 | 4 | (2) | C | 3 | 236.25 |
| 15 | 2 | 4 | (3) | B | 2 | 213.75 |
| 16 | 4 | 4 | (4) | A | 4 | 191.25 |
| 17 | 1 | 1 | (1) | D | 1 | 168.75 |

Number 17 firing is bank No. 1's number 1 capacitor discharging for only the second time in the 17 firing sequence. The time between firing No. 2 and No. 17 is available for completely charging bank No. 1's number 1 capacitor. Notice that each successive firing takes place from different bays of the compound rotors, D,C, B, then A. This is to select successive capacitors in each reservior bank.

FIG. 5 shows the angular position in all rotors (4) of the high energy distribution system. This is only one of the four used in the 4 bank, 4 chamber system. A,B,C, and D are four separate rotors rotating in synchronism, driven by the engine crankshaft. The speed of the 4 bay rotor shaft is ¼ of the speed of the ignition rotor. Slotted insulators at 180,90,0 and 270 degrees, isolate banks. Arcing may be reduced by separating capacitor discharge from the rotor ring. This syncs a low level pulse to parallel ignition in separate SCR gates, thus relieving high current release on the rotor mechanical slide path in each section. SCR power capability will limit the total power of the discharge in this case.

Thus it will be seen that I have provided a novel and efficient explosion engine capable of exploding various fuels of less combustible vapor than gasoline, and have provided automatically set timing for triggering a high energy exploding sequence, -obtaining such high energy through condensor banks and high current diode stacks.

While I have illustrated and described several embodiments of my invention, it will be understood that these are by way of illustration only and that various changes and modifications are contemplated within the scope of the following claims.

I claim:

1. A high energy electrical ignition and discharge system for an internal combustion engine to enable explosion of powdered and liquid fuels, comprising an explosion cylinder having a single ignition and discharge electrode inside the top center of said cylinder, an ignition coil connected between ground and said electrode, a bank of high voltage capacitors energized by a source of high D.C. voltage, high voltage high current diode stack which are connected between said electrode and said high voltage capacitors isolated from said ignition coil, whereby high current discharge by said capacitors is effected by said electrode in the fuel mixture of said combustion chamber.

2. A system as recited in claim 1 wherein said electrode is spherical, wherein a condenser is connected between said ignition coil and electrode, wherein said diode stack contains in excess of 200 diodes and wherein said source of high D.C. voltage comprises a DC to DC converter fed by storage batteries.

3. A system as recited in claim 2 wherein a dwell rheostat is connected between said bank of high voltage capacitors and said diode stack to vary the parameters for selective fuels used.

4. A system as recited in claim 2 wherein a variable number of said storage batteries is provided as well as a variable number of said capacitors to enable adjustment of the electrical power input for various selected fuels.

5. A system as recited in claim 2 wherein about 288 diodes are included in said stack having a total peak inverse voltage of about 24 kilovolts for ignition and a high energy current surge of about 600 amperes at about 200 volts producing an energy source of relatively high capacity and low voltage as compared to a more dangerous high voltage, low capacity characteristic.

6. A system as recited in claim 1 wherein multiple cylinders are included in said engine, each having said electrode which is of spherical shape, and wherein only one of said cylinders is connected to said diode stack and bank of high voltage capacitors at any one time.

7. A system as recited in claim 1 including a grounded discharge ring in said cylinder adjacent said electrode and wherein said system is devoid of power transistors and silicon controlled rectifiers.

8. A system as recited in claim 1 wherein additional capacitors for a single cylinder are discharged in sequence through a synchronized rotor allowing higher speed discharge rates and shorter intervals between discharges by alternate source selection.

9. A system as recited in claim 1 including a four cylinder engine and a switching system which allows said bank of capacitors to charge in reserve while other chambers are ignited to enable high speed release of energy.

10. A system as recited in claim 9 wherein four alternate banks of capacitors are used, totalling 16 capacitors, which provide the timing for the high electrical power distribution, including four capacitors per cylinder, each charging and discharging separately in sequence with one cylinder having four capacitors discharging into said cylinder, one after the other on different cycles, increasing charging time for each capacitor allowing maximum energy build up at high revolutions per minute.

* * * * *